US008985346B2

(12) United States Patent
Bogdziewicz et al.

(10) Patent No.: US 8,985,346 B2
(45) Date of Patent: Mar. 24, 2015

(54) MULTI-DECK PRODUCT DISPENSING SYSTEM WITH REAR GUIDE

(75) Inventors: William J. Bogdziewicz, Richmond, VA (US); Caleb S. Loftin, Richmond, VA (US); Aaron L. Bates, Moseley, VA (US); Steven Burton, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 127 days.

(21) Appl. No.: 13/227,542

(22) Filed: Sep. 8, 2011

(65) Prior Publication Data

US 2013/0062360 A1 Mar. 14, 2013

(51) Int. Cl.

| | |
|---|---|
| ***A47F 1/04*** | (2006.01) |
| ***A47F 7/00*** | (2006.01) |
| ***A47F 1/08*** | (2006.01) |
| ***G07F 11/30*** | (2006.01) |
| ***G07F 11/34*** | (2006.01) |

(52) U.S. Cl.

CPC ..... *A47F 1/087* (2013.01); *G07F 11/30* (2013.01); *G07F 11/34* (2013.01)

USPC ..... 211/59.2

(58) Field of Classification Search

CPC ..... A47F 1/087

USPC ..... 211/59.2, 59.3, 74; 221/282, 197, 194, 221/198, 17, 31, 175, 176, 185, 285, 287

See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,383,318 | A | 7/1921 | McCormick |
| 1,393,964 | A | 10/1921 | Potts et al. |

(Continued)

FOREIGN PATENT DOCUMENTS

| | | |
|---|---|---|
| AT | 6036 U1 | 3/2003 |
| DE | 2655496 | 6/1978 |

(Continued)

OTHER PUBLICATIONS

International Search Report and Written Opinion issued in PCT/US2010/057020 (Mar. 8, 2011).

(Continued)

*Primary Examiner* — Joshua Rodden
*Assistant Examiner* — Kimberley S Wright
(74) *Attorney, Agent, or Firm* — MeadWestvacp Intellectual Property Group

(57) ABSTRACT

A product dispensing system including a frame structure having a front end and a rear end, the frame structure including an upper support deck extending between the front and rear ends, a lower support deck positioned below the upper support deck, the lower support deck extending between the front and rear ends and defining a first product display area, and an intermediate support deck positioned between the upper support deck and the lower support deck, the intermediate support deck extending between the front and rear ends and defining a second product display area, wherein the upper support deck and the intermediate support deck define a vertical drop zone proximate the rear end, the vertical drop zone extending from the upper support deck to the lower support deck, and a guide positioned between the upper support deck and the intermediate support deck, the guide extending into the vertical drop zone.

12 Claims, 5 Drawing Sheets

(56) References Cited

U.S. PATENT DOCUMENTS 1,753,957 A 4/1930 Washburn
1,824,937 A 9/1931 Trouth
1,858,199 A 10/1932 Maziroff
1,898,056 A 2/1933 Johnson
1,919,907 A 7/1933 Robinson
1,932,225 A 10/1933 Minter
1,941,458 A 2/1934 Bens
1,985,739 A 12/1934 Murray
2,078,599 A 4/1937 McCauley
2,110,194 A 3/1938 Blier
2,263,353 A 11/1941 Eidam
2,291,187 A 7/1942 Johnson
2,382,191 A 7/1944 Weichselbaum
2,536,421 A 2/1951 Burhans
2,573,381 A 10/1951 Arnold
2,574,087 A 11/1951 Burhans
2,595,122 A 4/1952 Burhans
2,732,619 A 1/1956 Labine
2,784,871 A 3/1957 Gabrielsen
2,795,845 A 6/1957 Shimer
2,818,978 A 1/1958 Post
2,826,471 A 3/1958 Fonda
2,831,591 A 4/1958 Morton
2,888,145 A 5/1959 Knott et al.
2,915,162 A 12/1959 Umstead
2,915,932 A 12/1959 Gross
2,919,488 A 1/1960 Brownlee
2,996,344 A 8/1961 Garman
3,018,149 A 1/1962 Parker
3,055,293 A 9/1962 Lariccia
3,066,827 A 12/1962 Pryor
3,137,068 A 6/1964 Quigley
D198,888 S 8/1964 Heselov
3,178,242 A 4/1965 Ellis et al.
3,184,104 A 5/1965 De Domenico et al.
3,203,554 A 8/1965 Pendergrast et al.
3,204,335 A 9/1965 Hughes
3,288,544 A 11/1966 Knecht
3,300,115 A 1/1967 Schauer
3,304,141 A 2/1967 Rogers
3,318,455 A 5/1967 Takahashi
3,335,940 A 8/1967 Dykes
3,340,790 A 9/1967 Simjian
3,348,738 A 10/1967 Hertlein
3,379,294 A * 4/1968 Van Liew, Jr. ..... 193/2 R
3,392,901 A 7/1968 Krzyzanowski
3,393,808 A 7/1968 Chirchill
3,501,016 A 3/1970 Eaton
3,664,545 A * 5/1972 Besley ..... 221/176
3,763,557 A 10/1973 Sewell
3,784,022 A 1/1974 Beesley, Jr.
3,922,778 A 12/1975 Aalpoel
3,923,159 A 12/1975 Taylor et al.
3,972,454 A 8/1976 Croley
4,105,126 A 8/1978 Deffner et al.
4,205,440 A 6/1980 Morgan
4,260,072 A 4/1981 Quasarano
4,318,458 A 3/1982 Ritsema
4,382,526 A 5/1983 Stone
4,396,143 A 8/1983 Killy
4,435,026 A 3/1984 Johnson
4,467,524 A 8/1984 Ruff et al.
4,576,272 A 3/1986 Morgan, Jr.
4,598,828 A 7/1986 Young et al.
4,729,480 A 3/1988 Groover et al.
4,744,489 A 5/1988 Binder et al.
4,834,263 A 5/1989 Becze
4,869,395 A 9/1989 Rubbmark
4,911,309 A 3/1990 Stefan
4,915,571 A 4/1990 Toshihiko et al.
4,923,070 A 5/1990 Jackle et al.
4,997,106 A 3/1991 Rockola
4,998,628 A 3/1991 Ross
5,033,348 A 7/1991 Walsh
5,080,256 A 1/1992 Rockola
5,101,703 A 4/1992 Tanaka et al.
5,167,345 A 12/1992 Bleeker
5,190,155 A 3/1993 Grunwald
5,251,972 A 10/1993 Zurawin
5,289,943 A 3/1994 Powell
5,314,078 A 5/1994 Morikiyo et al.
5,328,258 A 7/1994 Scalise
5,356,033 A 10/1994 Delaney
5,372,278 A 12/1994 Leight
5,390,821 A 2/1995 Markel
5,396,997 A 3/1995 Johnson
D363,174 S 10/1995 Fletcher, Sr.
5,462,198 A 10/1995 Schwimmer
5,529,207 A 6/1996 Oden et al.
5,638,988 A 6/1997 Rogers
5,685,664 A 11/1997 Parham et al.
5,740,610 A 4/1998 Ayer et al.
5,788,117 A 8/1998 Zimmanck
5,791,048 A 8/1998 Bodnar et al.
5,836,478 A 11/1998 Weiss
5,878,862 A 3/1999 Dewsnap
5,894,942 A 4/1999 Miyashita et al.
5,924,573 A 7/1999 Piraneo et al.
5,992,286 A 11/1999 Boole
5,992,652 A 11/1999 Springs
6,186,345 B1 2/2001 Robertson
6,199,720 B1 3/2001 Rudick et al.
6,206,237 B1 3/2001 Dillon et al.
6,253,930 B1 7/2001 Freidus et al.
6,267,258 B1 7/2001 Wilkerson et al.
6,393,799 B2 5/2002 Jenkins et al.
6,453,641 B1 9/2002 Puckett
6,637,604 B1 10/2003 Jay
6,802,433 B2 10/2004 Leykin
6,991,116 B2 1/2006 Johnson et al.
7,207,447 B2 4/2007 Medcalf et al.
7,303,095 B2 12/2007 Nagelski et al.
7,546,973 B2 6/2009 Budz et al.
7,584,854 B2 9/2009 Chandaria
7,614,543 B1 11/2009 Miller
D604,972 S 12/2009 Henry et al.
7,665,618 B2 2/2010 Jay et al.
7,681,745 B2 3/2010 Richter
7,690,518 B2 4/2010 Fincher et al.
7,757,890 B2 7/2010 Alford et al.
7,810,672 B1 10/2010 Mason et al.
7,823,733 B2 11/2010 Futori
7,841,479 B2 11/2010 Budge et al.
7,850,015 B1 12/2010 Mason
7,913,860 B2 3/2011 Merl
7,918,365 B2 4/2011 White et al.
7,922,437 B1 4/2011 Loftin et al.
7,992,747 B2 8/2011 Bauer
8,028,855 B2 10/2011 White et al.
8,047,400 B1 11/2011 Luberto et al.
8,302,809 B1 11/2012 Bogdziewicz et al.
8,308,023 B2 11/2012 Gelardi et al.
2002/0043509 A1 4/2002 Lajeunesse et al.
2003/0173322 A1 9/2003 Rushing
2004/0011751 A1 1/2004 Johnson et al.
2004/0079760 A1 4/2004 Rink
2004/0262326 A1 12/2004 Christensen
2005/0092644 A1 5/2005 Cafferata
2005/0127015 A1 6/2005 Medcalf et al.
2005/0207877 A1 9/2005 Haverdink
2006/0081692 A1 4/2006 Stewart et al.
2006/0237384 A1 10/2006 Neumann et al.
2006/0243683 A1 11/2006 Onachilla et al.
2006/0278591 A1 12/2006 Tippets et al.
2007/0194037 A1 8/2007 Close
2008/0067188 A1* 3/2008 White et al. ..... 221/123
2008/0245813 A1 10/2008 Johnson et al.
2009/0212066 A1 8/2009 Bauer
2009/0266776 A1 10/2009 Johnson
2009/0277853 A1 11/2009 Bauer
2009/0308885 A1 12/2009 Sainato et al.
2010/0032391 A1 2/2010 Schneider et al.
2010/0096401 A1 4/2010 Sainato et al.
2011/0121010 A1 5/2011 Loftin et al.

(56) References Cited

U.S. PATENT DOCUMENTS

| | | | |
|---|---|---|---|
| 2011/0121011 | A1 | 5/2011 | Gelardi et al. |
| 2011/0121022 | A1 | 5/2011 | Sholl et al. |
| 2012/0018391 | A1 | 1/2012 | Gelardi et al. |
| 2012/0074016 | A1 | 3/2012 | Gelardi et al. |
| 2012/0074160 | A1 | 3/2012 | Thomas et al. |
| 2012/0074164 | A1 | 3/2012 | Walling et al. |
| 2012/0080513 | A1 | 4/2012 | Thomas et al. |
| 2012/0097694 | A1 | 4/2012 | Gelardi |
| 2012/0152970 | A1 | 6/2012 | Thomas |
| 2012/0211522 | A1 | 8/2012 | Gelardi et al. |
| 2012/0217213 | A1 | 8/2012 | Thomas |
| 2012/0217261 | A1 | 8/2012 | Bailey et al. |
| 2012/0223090 | A1 | 9/2012 | Thomas et al. |
| 2012/0279893 | A1 | 11/2012 | Gelardi et al. |
| 2012/0285976 | A1 | 11/2012 | Bogdziewicz et al. |
| 2012/0285977 | A1 | 11/2012 | Bates et al. |

FOREIGN PATENT DOCUMENTS

| | | | | | |
|---|---|---|---|---|---|
| DE | 29808673 | | | 11/1998 | |
| DE | 19808162 | | | 9/1999 | |
| DE | 20111307 | | | 10/2001 | |
| DE | 202007012114 | | | 11/2007 | |
| FR | 2415051 | | | 8/1979 | |
| GB | 1283210 | | | 7/1972 | |
| GB | 2190906 | | | 12/1978 | |
| GB | 2036706 | A | * | 7/1980 | ..... A47F 1/08 |
| GB | 2303624 | | | 2/1997 | |
| JP | 3273472 | | * | 3/1991 | |
| JP | 03105494 | A | | 5/1991 | |
| JP | 03133737 | A | | 6/1991 | |
| JP | 03198192 | A | | 8/1991 | |
| JP | 03273469 | A | | 12/1991 | |
| JP | 03273470 | A | | 12/1991 | |
| JP | 03273471 | A | | 12/1991 | |
| JP | 03273472 | A | | 12/1991 | |
| JP | 03273474 | A | | 12/1991 | |
| JP | 03273476 | A | | 12/1991 | |
| JP | 03273477 | A | | 12/1991 | |
| JP | 03273480 | A | | 12/1991 | |
| JP | 03273482 | A | | 12/1991 | |
| JP | 03273483 | A | | 12/1991 | |
| JP | 04086985 | A | | 3/1992 | |
| JP | 04115392 | A | | 4/1992 | |
| JP | 04137194 | A | | 5/1992 | |
| JP | 05004640 | A | | 1/1993 | |
| JP | 05174239 | A | | 7/1993 | |
| JP | 05346984 | A | | 12/1993 | |
| JP | 08161611 | A | | 6/1996 | |
| JP | 09027066 | A | | 1/1997 | |
| JP | 09102065 | A | | 4/1997 | |
| JP | 09282537 | A | | 10/1997 | |
| JP | 09311971 | A | | 12/1997 | |
| JP | 10269421 | A | | 10/1998 | |
| JP | 11011471 | A | | 1/1999 | |
| JP | 11171264 | A | | 6/1999 | |
| JP | 11191175 | A | | 7/1999 | |
| JP | 11328513 | A | | 11/1999 | |
| JP | 2001072076 | A | | 3/2001 | |
| JP | 2001206358 | A | | 7/2001 | |
| JP | 2003327243 | A | | 11/2003 | |
| JP | 2004017970 | A | | 1/2004 | |
| JP | 2005338910 | A | | 12/2005 | |
| JP | 04157593 | B1 | | 10/2008 | |
| WO | WO-9106076 | A1 | | 5/1991 | |
| WO | WO 9321074 | | | 10/1993 | |
| WO | WO 9423619 | | | 10/1994 | |
| WO | WO 0054632 | | | 9/2000 | |
| WO | WO 2004014755 | | | 2/2004 | |
| WO | WO 2004113808 | | | 12/2004 | |
| WO | WO 2009138538 | | | 11/2009 | |
| WO | WO 2011025483 | | | 3/2011 | |
| WO | WO 2011030320 | | | 3/2011 | |
| WO | WO 2011109350 | | | 9/2011 | |

OTHER PUBLICATIONS

International Search Report and Written Opinion issued in PCT/US2010/057221 (Mar. 4, 2011).

* cited by examiner

MULTI-DECK PRODUCT DISPENSING SYSTEM WITH REAR GUIDE

FIELD

This application relates to the dispensing of products from packaging containers and, more particularly, to dispensers for dispensing products initially provided in packaging containers.

BACKGROUND

Products are typically shipped to retailers in bulk by enclosing multiple individual product units in a container, such as a carton or box. For example, canned beverages may be shipped to a retailer in a carton containing twelve individual cans. When the products are to be sold individually, the retailer must remove the individual product units from the carton and stack them on a display, such as a shelf.

Alternatives to the traditional package-ship-unpack-display model have been developed in an effort to improve operating efficiency. For example, U.S. Ser. No. 13/184,639 filed on Jul. 18, 2011, the entire contents of which are incorporated herein by reference, discloses a gravity-fed product dispensing system with multiple dispensing decks. The system includes a dispenser configured with an upper deck for supporting a container and multiple dispensing decks positioned below the upper deck, wherein each dispensing deck includes a product display area. The dispenser may be positioned on a retailer's shelf and loaded with product simply by placing a container comprising multiple units of product onto the upper deck of the dispenser. Once the container is positioned on the upper deck, the products exit the container through an opening in the container and travel to the product display areas under the force of gravity. Consumers may retrieve the products from the product display areas.

Despite advances already made in the field, those skilled in the art continue with research and development efforts directed to apparatus and systems for dispensing products initially provided in packaging containers.

SUMMARY

In one aspect, the disclosed multi-deck product dispensing system may include a frame structure having a front end and a rear end, the frame structure including an upper support deck extending between the front and rear ends, a lower support deck positioned below the upper support deck, the lower support deck extending between the front and rear ends and defining a first product display area, and an intermediate support deck positioned between the upper support deck and the lower support deck, the intermediate support deck extending between the front and rear ends and defining a second product display area, wherein the upper support deck and the intermediate support deck define a vertical drop zone proximate the rear end, the vertical drop zone extending from the upper support deck to the lower support deck, and a guide positioned between the upper support deck and the intermediate support deck, the guide extending into the vertical drop zone.

In another aspect, the disclosed multi-deck product dispensing system may include a frame structure having a front end and a rear end, the frame structure including a rear wall proximate the rear end, an upper support deck extending between the front end and the rear end, the upper support deck defining a first opening proximate the rear wall, a lower support deck positioned below the upper support deck, the lower support deck extending between the front end and the rear end and defining a first product display area proximate the front end, and an intermediate support deck positioned between the upper support deck and the lower support deck, the intermediate support deck extending between the front end and the rear end and defining a second product display area proximate the front end, the intermediate support deck defining a second opening proximate the rear wall, wherein the first opening and the second opening define a vertical drop zone extending from the upper support deck to the lower support deck, and a guide connected to the rear wall between the upper support deck and the intermediate support deck, the guide protruding from the rear wall into the vertical drop zone.

In yet another aspect, disclosed is a method for dispensing a plurality of products initially provided in a container. The method may include the steps of (1) providing a dispenser including a frame structure having a front end and a rear end, the frame structure including a rear wall proximate the rear end, an upper support deck extending between the front end and the rear end, the upper support deck defining a first opening proximate the rear wall, a lower support deck positioned below the upper support deck, the lower support deck extending between the front end and the rear end and defining a first product display area, and an intermediate support deck positioned between the upper support deck and the lower support deck, the intermediate support deck extending between the front end and the rear end and defining a second product display area, the intermediate support deck defining a second opening proximate the rear wall, wherein the first opening and the second opening define a vertical drop zone extending from the upper support deck to the lower support deck, (2) positioning a guide between the upper support deck and the intermediate support deck such that the guide extends into the vertical drop zone, (3) forming an exit opening in the container and (4) positioning the container on the upper support deck to align the exit opening with the vertical drop zone such that at least one product exits the container and moves through the vertical drop zone into engagement with the guide.

Other aspects of the disclosed multi-deck product dispensing system and method with rear guide will become apparent from the following detailed description, the accompanying drawings and the appended claims.

DETAILED DESCRIPTION

Figure 1:
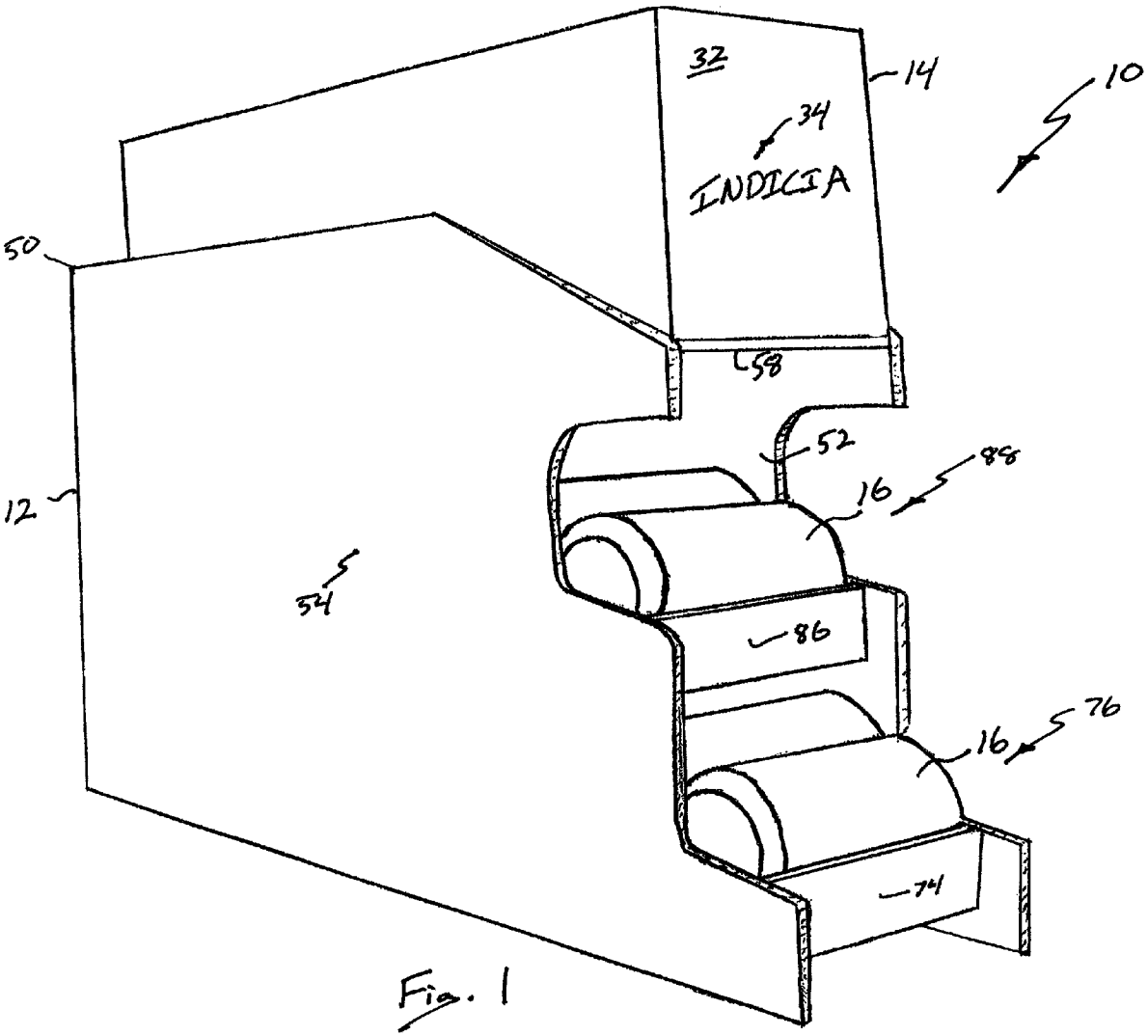
FIG. 1 is a front and side perspective view of one aspect of the disclosed multi-deck product dispensing system with rear guide.
Figure 2:
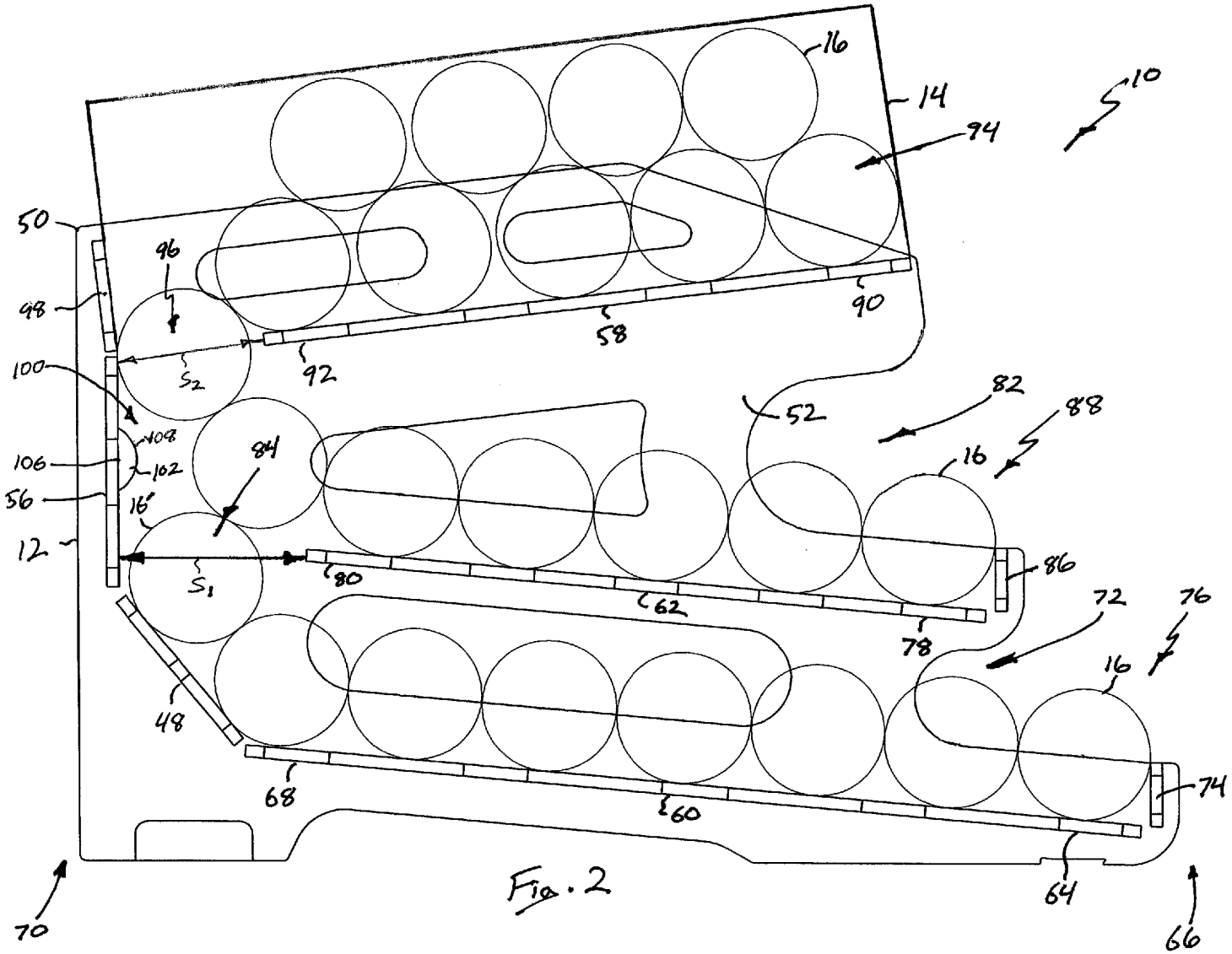
FIG. 2 is a side elevational view, in section, of the product dispensing system of FIG. 1.

Referring to FIGS. 1 and 2, one aspect of the disclosed multi-deck product dispensing system with rear guide, generally designated 10, may include a dispenser 12 and a container 14. The container 14 may initially house multiple units of product 16, such as cans (e.g., canned soft drinks), jars (e.g., jarred soup) or bottles (e.g., bottled sauce). The products 16 may be released from the container 14 into the dispenser 12 when the container 14 is opened and loaded onto the dispenser 12.

Figure 3:
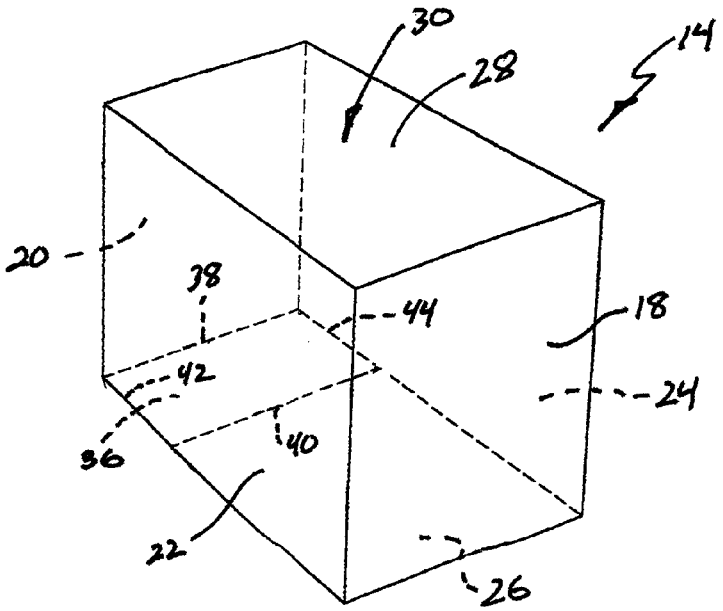
FIG. 3 is a front perspective view of the container of the product dispensing system of FIG. 1.

The container 14 may be any container capable of initially housing the products 16 and beneficially interacting with the dispenser 12. For example, as shown in FIG. 3, the container 14 may be a paperboard carton or a corrugated box having six walls 18, 20, 22, 24, 26, 28 that define an internal volume 30 for receiving the products 16 (FIGS. 1 and 2). Opposed walls 18, 20 may define the front and rear walls, respectively, of the container 14. Opposed walls 22, 24 may define the left and right side walls, respectively, of the container 14. Opposed walls 26, 28 may define the base and upper walls, respectively, of the container 14.

In accordance with well-established techniques, the container 14 may be assembled on a container machine using a container blank that has been pre-cut from a sheet of stock material. As one example, the stock material may be a paperboard-based material, such as C1S paperboard, which may have a coating (e.g., clay) on a first major surface thereof, which may form the outer surface of the container 14, and an uncoated second major surface. As another example, the stock material may be C2S paperboard, which may have a coating (e.g., clay) on both major surfaces thereof. Optionally, the outer surface 32 (FIG. 1) of the container 14 may be marked with various indicia 34 (FIG. 1), such as printed text and graphics.

Still referring to FIG. 3, the container 14 may include a removable opening feature 36 in at least one wall (e.g., the base wall 26). The removable opening feature 36 may be defined by weakened severance lines 38, 40, 42, 44. The weakened severance lines 38, 40, 42, 44 may be formed by weakening the container 14, such as with score lines, perforations or zipper-like cuts, to facilitate tearing the removable opening feature 36 from the container 14 along the weakened severance lines 38, 40, 42, 44.

Figure 4:
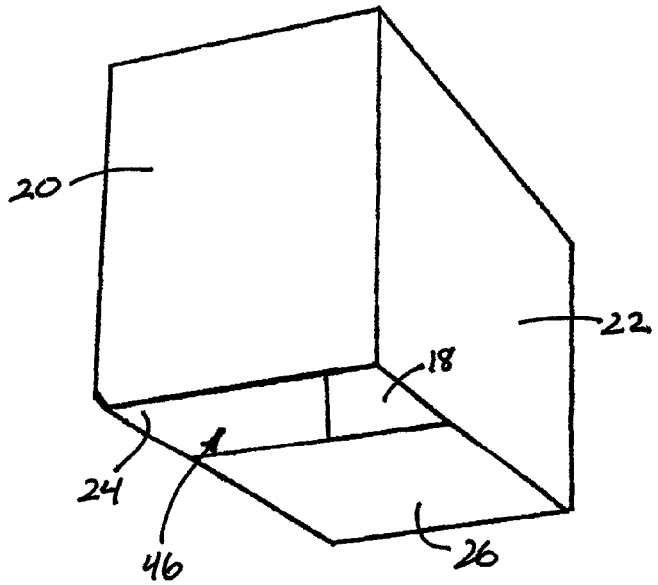
FIG. 4 is a rear and bottom perspective view of the container of FIG. 3 shown in an open configuration.

Thus, as shown in FIG. 4, the removable opening feature 36 may be removed from the container 14 to form an opening 46 into the internal volume 30 of the container 14. The opening 46 may extend generally laterally between the side walls 22, 24 of the container 14, and may be positioned proximate the rear wall 20 of the container 14 such that the products 16 (FIG. 1) may exit the container 14 through the opening 46. Those skilled in the art will appreciate that the step of removing the removable opening feature 36 from the container 14 may be performed prior to loading the container 14 onto the dispenser 12.

In an alternative embodiment, the dispenser 12 may include an opening tool (not shown) arranged to automatically form the opening 46 in the container 14 as the container 14 is loaded onto the dispenser 12 (e.g., by sliding the container 14 longitudinally along the upper support deck 58 of the dispenser 12). The use of an opening tool associated with a dispenser to automatically form an opening in a container is described in greater detail in U.S. Ser. No. 13/184,639 (discussed above), as well as in U.S. Pat. No. 7,922,437 issued on Apr. 12, 2011, the entire contents of which are incorporated herein by reference. Those skilled in the art will appreciate that the use of an opening tool may eliminate the need for removing the removable opening feature 36 from the container 14 prior to loading the container 14 onto the dispenser 12.

Referring back to FIGS. 1 and 2, the dispenser 12 may include a frame structure 50 that supports the container 14 and products 16 in a desired configuration. The frame structure 50 may include a first (e.g., right) side wall 52, a second (e.g., left) side wall 54, a rear wall 56, an upper support deck 58, a lower support deck 60 and one or more intermediate support decks 62 (only one is shown in FIGS. 1 and 2) positioned between the upper support deck 58 and the lower support deck 60. The frame structure 50 may define a front end portion 66 and a rear end portion 70, wherein the rear end 70 is longitudinally opposed from the front end 66.

The right side wall 52 may be laterally spaced from the left side wall 54, and may be generally parallel with the left side wall 54. The spacing between the right and left side walls 52, 54 may be sized to closely receive the products 16 in a rolling configuration, thereby providing lateral containment for the products 16 within the frame structure 50.

The rear wall 56 may be positioned proximate the rear end 70 of the frame structure 50, and may laterally extend between the right and left side walls 52, 54. The rear wall 56 may be generally vertically arranged, though an angled rear wall 56 (i.e., angled relative to vertical in side view) may be used without departing from the scope of the present disclosure.

The lower support deck 60 may laterally extend between the right and left side walls 52, 54, and may include a front end 64 that longitudinally extends toward the front end 66 of the frame structure 50 and a rear end 68 that longitudinally extends toward the rear end 70 of the frame structure 50. Therefore, the lower support deck 60 and the side walls 52, 54 may define a lower level 72 of the frame structure 50.

The lower support deck 60 may be inclined from the front end 64 to the rear end 68 (i.e., the rear end 68 may be elevated relative to the front end 64) such that products 16 deposited proximate the rear end 68 of the lower support deck 60 roll down to the front end 64 of the lower support deck 60 under the force of gravity. The extent of the incline of the lower support deck 60 may be dictated by, among other things, the coefficient of friction of the material used to form the frame structure 50 and the shape of the products 16 to be dispensed by the dispenser 12.

A ramp 48 may be positioned between the rear wall 56 of the frame structure 50 and the rear end 68 of the lower support deck 60. The ramp 48 may provide a gradual vertical-to-horizontal transition for products 16 dropping down to the lower level 72.

A stop 74 may be positioned proximate the front end 64 of the lower support deck 60 to prevent products 16 from rolling beyond the front end 64 of the lower support deck 60. Therefore, the stop 74 may collect products 16 at the front end 64 of the lower support deck 60, thereby defining a first product display area 76 proximate the front end 64 of the lower support deck 60. The first product display area 76 may be configured to allow consumers to retrieve products 16 from the lower level 72 of the dispenser 12.

The intermediate support deck 62 may be positioned between the upper support deck 58 and the lower support deck 60. The intermediate support deck 62 may laterally extend between the right and left side walls 52, 54, and may include a front end 78 that longitudinally extends toward the front end 66 of the frame structure 50 and a rear end 80 that longitudinally extends toward, but not to, the rear wall 56 of the frame structure 50. Therefore, the intermediate support deck 62 and the side walls 52, 54 may define an intermediate level 82 of the frame structure 50.

The spacing $S_1$ between the rear end 80 of the intermediate support deck 62 and the rear wall 56 of the frame structure 50 may define an opening 84, which may function as a chute to allow products 16 to move from the intermediate level 82 down to the lower level 72 of the frame structure 50 under the force of gravity.

The intermediate support deck 62 may be inclined from the front end 78 to the rear end 80 (i.e., the rear end 80 may be elevated relative to the front end 78) such that products 16 deposited proximate the rear end 80 of the intermediate support deck 62 roll down to the front end 78 of the intermediate support deck 62 under the force of gravity. The extent of the incline of the intermediate support deck 62 may be dictated by, among other things, the coefficient of friction of the material used to form the frame structure 50 and the shape of the products 16 to be dispensed by the dispenser 12.

A stop 86 may be positioned proximate the front end 78 of the intermediate support deck 62 to prevent products 16 from rolling beyond the front end 78 of the intermediate support deck 62. Therefore, the stop 86 may collect products 16 at the front end 78 of the intermediate support deck 62, thereby defining a second product display area 88 proximate the front end 78 of the intermediate support deck 62. The second product display area 88 may be configured to allow consumers to retrieve products 16 from the intermediate level 82 of the dispenser 12.

Optionally, the second product display area 88 may be longitudinally (e.g., inwardly) displaced relative to the first product display area 76 such that the second product display area 88 does not obstruct access to the first product display area 76. As an example, the longitudinal displacement may correspond to the width of one product 16.

The upper support deck 58 may laterally extend between the right and left side walls 52, 54, and may include a front end 90 that longitudinally extends toward the front end 66 of the frame structure 50 and a rear end 92 that longitudinally extends toward, but not to, the rear wall 56 of the frame structure 50. Therefore, the upper support deck 58 and the side walls 52, 54 may define an upper level 94 of the frame structure 50.

The spacing $S_2$ between the rear end 92 of the upper support deck 58 and the rear wall 56 of the frame structure 50 may define an opening 96, which may function as a chute to allow products 16 to move from the upper level 94 down to the intermediate 82 and lower 72 levels of the frame structure 50 under the force of gravity.

The upper support deck 58 may be declined from the front end 90 to the rear end 92 (i.e., the front end 90 may be elevated relative to the rear end 92). Therefore, products 16 supported on the upper support deck 58 may roll under the force of gravity down to the rear end 92 of the upper support deck 58, through the opening 96, to the lower and intermediate levels 72, 82 of the frame structure 50 and, ultimately, to the first and second product display areas 76, 88.

Optionally, a stop 98 may be connected proximate the rear end 70 of the frame structure 50. The stop 98 may extend into the upper level 94 of the frame structure 50 to inhibit rearward horizontal movement of the container 14 along the upper support deck 58 beyond the stop 98. Furthermore, the stop 98 may ensure alignment of the opening 46 (FIG. 4) in the container 14 with the opening 96 of the upper level 94 of the frame structure 50.

Thus, the openings 84, 96 in the intermediate and upper levels 82, 94, respectively, may define a vertical drop zone 100 proximate the rear end 70 of the frame structure 50. The vertical drop zone 100 may extend from the upper level 94 to the lower level 72 of the frame structure 50. Products 16 exiting the opening 46 (FIG. 4) in the container 14 may fall through at least a portion of the vertical drop zone 100 as the products 16 travel (under the force of gravity) to either the lower level 72 or the intermediate level 82 and, ultimately, to either the first product display area 76 or the second product display area 88.

A guide 102 may be position proximate the rear wall 56 of the frame structure 50, and may protrude into the vertical drop zone 100 to beneficially interact with products 16 moving through the vertical drop zone 100. The guide 102 may introduce a slight forward, horizontal movement to the products 16 dropping through the vertical drop zone 100. The introduction of a slight forward, horizontal movement to the products 16 dropping through the vertical drop zone 100 may minimize (if not eliminate) the potential for products 16 becoming stuck on top of the last product 16' in the lower level 72 and forming a bridge that clogs the system 10 (e.g., prevents products 16 from moving onto the intermediate support deck 62).

Figure 5:
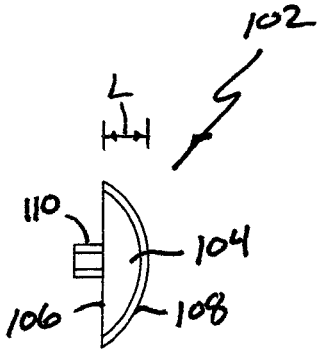
FIG. 5 is a side elevational view of the rear guide of the product dispensing system of FIG. 2.
Figure 6:
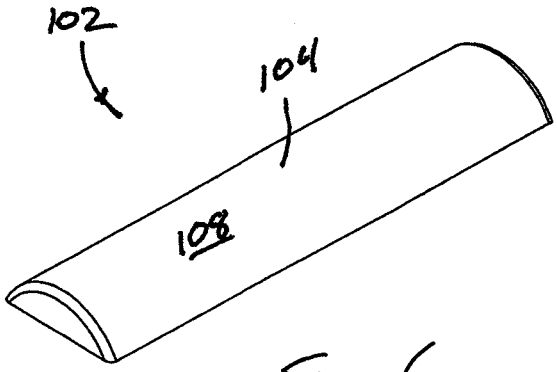
FIG. 6 is a front and side perspective view of the rear guide of FIG. 5.

Referring to FIGS. 5 and 6, the guide 102 may include an elongated body 104 having a mating surface 106 and an engagement surface 108. As shown in FIG. 2, the guide 102 may be connected to the rear wall 56 of the frame structure 50 such that the elongated body 104 of the guide 102 laterally extends between the side walls 52, 54 of the frame structure 50.

The guide 102 may be positioned below the upper support deck 58, but above the intermediate support deck 62. Therefore, the products 16 moving through the vertical drop zone 100 may interact with the guide 102 prior to reaching either the lower support deck 60 or the intermediate support deck 62.

In one construction, the guide 102 may be connected to the rear wall 56 of the frame structure 50 by mating the mating surface 106 of the guide 102 with the interior surface of the rear wall 56. For example, a tongue 110 (FIG. 5) may protrude from the mating surface 106 of the guide 102 and the rear wall 56 of the frame structure 50 may include a corresponding groove (not shown). Therefore, the guide 102 may be connected to the rear wall 56 of the frame structure 50 by inserting the tongue 110 into the groove. Other techniques for connecting the guide 102 to the rear wall 56 of the frame structure 50 will be readily apparent to this skilled in the art.

In another construction, the guide 102 may be integral with the rear wall 56 of the frame structure 50 (i.e., the guide 102 and rear wall 56 may be formed as a single, monolithic body).

The engagement surface 108 of the guide 102 may be contoured in various ways such that the engagement surface 108 protrudes away from the rear wall 56 (i.e., toward the front end 66 of the frame structure 50) and into the vertical drop zone 100. Therefore, products 16 moving from the upper level 94, through the opening 96 and dropping through the vertical drop zone 100 may come into contact with the engagement surface 108 of the guide 102 and may be at least slightly redirected away from the rear wall 56 of the frame structure 50 (i.e., may be urged slightly forward toward the intermediate support deck 62) upon making contact with the engagement surface 108.

The guide 102 may have a protruding length L (FIG. 5), which may be the maximum distance the guide 102 protrudes from the rear wall 56 into the vertical drop zone 100. The protruding length L may be sufficiently large to urge products 16 forward (i.e., toward the intermediate support deck 62) so as to avoid the problem of stacking of products 16 on top of the last product 16' in the lower level 72. However, the protruding length L may not be so large as to prevent products 16 from dropping through the opening 84 in the intermediate level 82 down to the lower level 72. Those skilled in the art will appreciate that using a guide 102 having a large protruding length L may require increasing the spacing $S_1$ between the rear end 80 of the intermediate support deck 62 and the rear wall 56 of the frame structure 50 to ensure that products 16 being redirected by the guide 102 are still capable of dropping to the lower level 72 of the frame structure 50.

In one embodiment, the guide 102 may be semi-circular in side view, thereby providing the engagement surface 108 with a rounded contour, as shown in FIGS. 5 and 6. Therefore, the upper portion of the guide 102 may urge products 16 forward, while the lower portion of the guide 102 may gradually direct products 16 toward the rear wall 56 of the frame structure 50.

Figure 7:
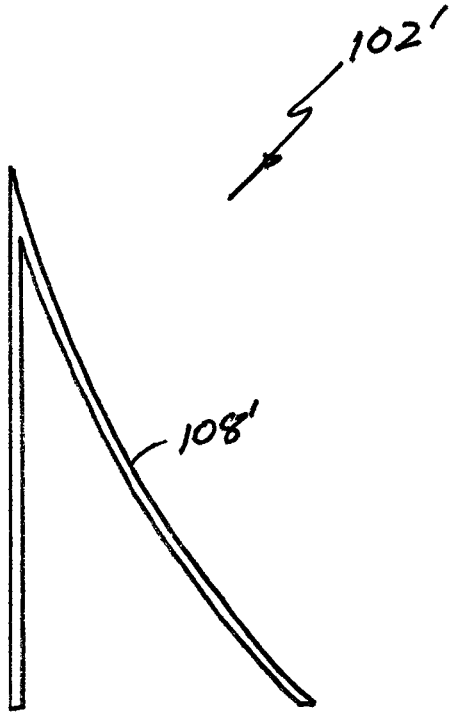
FIG. 7 is a side elevational view of an alternative embodiment of the rear guide of FIG. 5.

In another embodiment, the engagement surface 108' of the guide 102' may be contoured as a ramp, as shown in FIG. 7, or as a tear drop (not shown). The angle and curvature of the engagement surface 108' may be selected to direct dropping products 16 forward, but not so forward that the products 16 fail to drop through the opening 84 down to the lower level 72 of the frame structure 50.

At this point, those skilled in the art will appreciate that guides 102 of various shapes and configurations may be used to effect the beneficial redirection of products 16 dropping through the vertical drop zone 100.

Thus, the guide 102 may be positioned to interact with products 16 exiting through the opening 46 (FIG. 4) in the container 14, passing though the opening 96 in the upper level 94, and dropping through the vertical drop zone 100. The initial products 16 dropping through the vertical drop zone 100 may be urged slightly forward as they engage the guide 102, but may continue to drop down through the opening 84 in the intermediate level 82 to the lower level 72, where they may be gravity-biased toward the first product display area 76. Once the lower level 72 of the frame structure 50 has been filled with products 16 such that the opening 84 in the intermediate level 90 is bridged by a product 16', the remaining products 16 (i.e., the products 16 above the last product 16' in the lower level 72) may be urged slightly forward as they engage the guide 102 such that they are not stacked on top of the last product 16' in the lower level 72. Therefore, the remaining products 16 dropping through the vertical drop zone 100 may fill the intermediate level 82 of the frame structure 50, where they may be gravity-biased toward the second product display area 88.

The product dispensing system 10 may be assembled by opening the container 14 (e.g., tearing away the removable opening feature 36) and urging the opened container 14 along the upper support deck 58 of the dispenser 12 until the rear wall 20 of the container 14 comes into abutting engagement with the stop 98, thereby aligning the opening 46 in the container 14 with the opening 96 in the upper level 94 of the frame structure 50. With the opened container 14 loaded onto the dispenser 12, the force of gravity may urge the products 16 down through the vertical drop zone 100 of the frame structure 50, into engagement with the guide 102 and, ultimately, to the first and second product display areas 76, 88. Once the products from the container 14 have been transferred to the dispenser 12, a second container may be positioned on the upper support deck 58 of the dispenser 12. The products 16 in the second container may fill the dispenser 12 as customers remove products 16 by way of the first and second product display areas 76, 88.

Accordingly, the disclosed product dispensing system employs multiple support decks with product display areas, thereby increasing the amount of product being displayed to potential consumers and increasing the amount of product that may be supported by a given dispenser. Furthermore, the use of a guide may minimize (if not eliminate) the potential for product clogs in the system, thereby reducing (if not eliminating) the need for manual intervention to ensure proper dispensing.

Although various aspects of the disclosed multi-deck product dispensing system with rear guide have been shown and described, modifications may occur to those skilled in the art upon reading the specification. The present application includes such modifications and is limited only by the scope of the claims.

What is claimed is:

1. A product dispensing system comprising:

a frame structure having a front end and a rear end, said frame structure comprising:

a right side wall;

a left side wall laterally opposed from said right side wall;

an upper support deck fixedly connected between said right side wall and said left side wall and extending between said front end and said rear end, said upper support deck being declined from proximate said front end to proximate said rear end;

a lower support deck positioned below said upper support deck, said lower support deck being fixedly connected between said right side wall and said left side wall and extending between said front end and said rear end and defining a first product display area, said lower support deck being inclined from proximate said front end to proximate said rear end; and an intermediate support deck positioned between said upper support deck and said lower support deck, said intermediate support deck being fixedly connected between said right side wall and said left side wall and extending between said front end and said rear end and defining a second product display area, said intermediate support deck being inclined from proximate said front end to proximate said rear end, wherein a spacing is defined between said intermediate support deck and said rear end of said frame structure, and wherein said upper support deck and said intermediate support deck define a vertical drop zone extending from said upper support deck to said lower support deck, said vertical drop zone being proximate said rear end of said frame structure;

a container initially housing a plurality of products, wherein said container defines an opening, and wherein said opening is aligned with said vertical drop zone such that at least one product of said plurality of products exits said container through said opening and drops through said vertical drop zone when said container is positioned on said upper support deck, and a guide extending into said vertical drop zone and being displaced vertically below said upper support deck and displaced vertically above said intermediate support deck to urge a second product of said plurality of products toward said front end and onto said intermediate support deck when a first product of said plurality of products is positioned in said spacing, wherein said guide is semi-circular in side view.

2. The product dispensing system of claim 1 wherein said guide is elongated and laterally extends between said right and left side walls.

3. The product dispensing system of claim 1 wherein said frame structure further comprises a rear wall.

4. The product dispensing system of claim 3 wherein said upper support deck is spaced from said rear wall to define a first opening and said intermediate support deck is spaced from said rear wall to define a second opening, and wherein said first opening and said second opening define said vertical drop zone.

5. The product dispensing system of claim 3 wherein said guide protrudes from said rear wall into said vertical drop zone.

6. The product dispensing system of claim 3 wherein said guide is fixedly connected to said rear wall.

7. The product dispensing system of claim 3 wherein said guide is integral with said rear wall.

8. The product dispensing system of claim 1 wherein said first product display area is proximate said front end.

9. The product dispensing system of claim 1 wherein said second product display area is proximate said front end.

10. The product dispensing system of claim 1 further comprising an opening tool associated with said frame structure, said opening tool being arranged to automatically form said opening in said container when said container is urged along said upper support deck from said front end toward said rear end.

11. A method for dispensing a plurality of products initially provided in a container, said method comprising the steps of:

providing a dispenser comprising a frame structure having a front end and a rear end, said frame structure comprising:

a right side wall;

a left side wall laterally opposed from said right side wall;

a rear wall proximate said rear end;

an upper support deck fixedly connected between said right side wall and said left side wall and extending between said front end and said rear end, said upper support deck defining a first opening proximate said rear wall, said upper support deck being declined from proximate said front end to proximate said rear end;

a lower support deck positioned below said upper support deck, said lower support deck being fixedly connected between said right side wall and said left side wall and extending between said front end and said rear end and defining a first product display area, said lower support deck being inclined from proximate said front end to proximate said rear end; and an intermediate support deck positioned between said upper support deck and said lower support deck, said intermediate support deck being fixedly connected between said right side wall and said left side wall and extending between said front end and said rear end and defining a second product display area, said intermediate support deck defining a second opening proximate said rear wall, said intermediate support deck being inclined from proximate said front end to proximate said rear end;

forming an exit opening in said container;

positioning said container on said upper support deck to align said exit opening with said first opening such that at least one product of said plurality of products exits said container and drops through said first opening; and positioning a guide proximate said rear wall between said upper support deck and said intermediate support deck, said guide being displaced vertically below said upper support deck and displaced vertically above said intermediate support deck to urge a second product of said plurality of products toward said front end and onto said intermediate support deck when a first product of said plurality of products is positioned in said second opening;

wherein said guide is semi-circular in side view.

12. The method of claim 11, wherein said upper support deck and said intermediate support deck define a vertical drop zone extending from said upper support deck to said lower support deck, said vertical drop zone being proximate said rear end of said frame structure.

* * * * *